US011268746B2

(12) United States Patent
Zha

(10) Patent No.: US 11,268,746 B2
(45) Date of Patent: Mar. 8, 2022

(54) COOLING SYSTEM WITH PARTLY FLOODED LOW SIDE HEAT EXCHANGER

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 86 days.

(21) Appl. No.: 16/716,834

(22) Filed: Dec. 17, 2019

(65) Prior Publication Data

US 2021/0180851 A1 Jun. 17, 2021

(51) Int. Cl.

| | |
|---|---|
| ***F25D 11/02*** | (2006.01) |
| ***F25B 5/00*** | (2006.01) |
| ***F25B 9/00*** | (2006.01) |
| ***F25B 43/02*** | (2006.01) |
| ***F25D 11/04*** | (2006.01) |

(52) U.S. Cl.

CPC ..... *F25D 11/025* (2013.01); *F25B 5/00* (2013.01); *F25B 9/008* (2013.01); *F25B 43/02* (2013.01); *F25D 11/04* (2013.01)

(58) Field of Classification Search

CPC ..... F25D 11/025; F25D 43/02; F25D 5/00; F25D 11/04; F25D 9/008

See application file for complete search history.

(56) References Cited

U.S. PATENT DOCUMENTS

| | | | | |
|---|---|---|---|---|
| 6,662,576 | B1 * | 12/2003 | Bai | F25B 43/00 62/117 |
| 9,625,183 | B2 * | 4/2017 | Wallace | F25B 9/008 |
| 9,964,348 | B2 * | 5/2018 | Ali | F25B 49/02 |
| 9,982,919 | B2 * | 5/2018 | Ali | F25B 9/008 |
| 10,208,985 | B2 * | 2/2019 | Najafifard | F25B 41/00 |
| 2010/0251756 | A1 * | 10/2010 | Scarcella | F25B 31/002 62/457.9 |
| 2010/0326100 | A1 * | 12/2010 | Taras | F25B 1/10 62/115 |
| 2011/0023514 | A1 * | 2/2011 | Mitra | B60H 1/3228 62/222 |
| 2012/0011866 | A1 * | 1/2012 | Scarcella | B60H 1/3228 62/79 |
| 2012/0192579 | A1 * | 8/2012 | Huff | B60H 1/3228 62/115 |

(Continued)

FOREIGN PATENT DOCUMENTS

| | | |
|---|---|---|
| EP | 1577621 A2 | 9/2005 |
| EP | 1577621 A3 | 5/2006 |

(Continued)

OTHER PUBLICATIONS

European Patent Office, Extended European Search Report, Application No. 20211690.1, dated May 7, 2021, 9 pages.

*Primary Examiner* — Kun Kai Ma
(74) *Attorney, Agent, or Firm* — Baker Botts L.L.P.

(57) ABSTRACT

A cooling system is provided that partially floods one of its freezers (e.g., the ice cream freezer) such that the refrigerant discharged by the freezer includes a liquid component. In this manner, the freezers in the system can operate at the same saturated suction temperature. A heat exchanger can be used to transfer heat to the liquid component of the discharge to evaporate the liquid component.

20 Claims, 6 Drawing Sheets

(56) References Cited

U.S. PATENT DOCUMENTS

2012/0227427 A1* 9/2012 Liu ..... F25B 1/10 62/115
2012/0285185 A1* 11/2012 Huff ..... F25B 9/008 62/115
2012/0318006 A1* 12/2012 Liu ..... F25B 41/22 62/80
2012/0318008 A1* 12/2012 Liu ..... B60H 1/3228 62/115
2013/0031934 A1* 2/2013 Huff ..... F25B 1/10 62/510
2013/0251505 A1* 9/2013 Wang ..... F25B 9/008 415/1
2013/0312376 A1* 11/2013 Huff ..... F25B 43/00 55/457
2014/0157821 A1* 6/2014 Schrader ..... F25B 23/00 62/509
2014/0326018 A1* 11/2014 Ignatiev ..... F25B 49/02 62/510
2015/0204589 A1* 7/2015 Liu ..... F25B 47/02 62/80
2015/0219379 A1* 8/2015 Sun ..... F25B 9/008 62/115
2015/0233624 A1* 8/2015 Hellmann ..... F25B 49/022 62/117
2015/0300713 A1* 10/2015 Sun ..... B60H 1/3228 62/115
2015/0345835 A1* 12/2015 Martin ..... F25B 9/008 62/238.3
2016/0272047 A1* 9/2016 Gan ..... B60H 1/3223
2017/0138643 A1* 5/2017 Ignatiev ..... F25B 41/20
2018/0187927 A1* 7/2018 Zha ..... F25B 5/02
2018/0187928 A1* 7/2018 Zha ..... F25B 29/003
2018/0195773 A1* 7/2018 Saunders ..... F25B 31/004
2018/0216851 A1* 8/2018 Christensen ..... F25B 1/10
2018/0274823 A1* 9/2018 Rajendiran ..... F25B 40/02
2018/0328628 A1* 11/2018 Sun ..... F25B 9/008
2019/0041102 A1* 2/2019 Zha ..... F25B 31/006
2019/0072299 A1* 3/2019 Najafifard ..... F25B 7/00
2019/0161660 A1* 5/2019 Yana Motta ..... F25B 9/006

FOREIGN PATENT DOCUMENTS

EP 2721355 A2 4/2014
JP 2009030840 A 2/2009
WO WO-2008019689 A2 * 2/2008 ..... F25B 1/10
WO 2010061624 A1 6/2010

* cited by examiner

COOLING SYSTEM WITH PARTLY FLOODED LOW SIDE HEAT EXCHANGER

TECHNICAL FIELD

This disclosure relates generally to a cooling system.

BACKGROUND

Cooling systems may cycle a refrigerant (e.g., carbon dioxide refrigerant) to cool various spaces. These systems include compressors that compress the refrigerant.

SUMMARY

Cooling systems may cycle a refrigerant (e.g., carbon dioxide refrigerant) to cool various spaces. These systems include compressors that compress the refrigerant. One type of cooling system is a refrigeration and/or freezing system (e.g., refrigeration shelves and freezers in a grocery store). In these cooling systems, sometimes, the freezers are cooled to different temperatures to handle different types of products. For example, freezers for ice cream are typically kept at a colder temperature (e.g., −25 degrees Fahrenheit) than freezers for other frozen foods (e.g., −20 degrees Fahrenheit). As a result, the refrigerant discharged by these different freezers will be at different temperatures and/or pressures. To avoid having to use a different compressor to compress refrigerant discharged from these different freezers, conventional cooling systems may include electric expansion pressure control valves on the outlets of one or more of these freezers to regulate the pressure of the refrigerant discharged by these freezers. However, these pressure control valves may cause the compressors to use more energy to compress the refrigerant from these freezers.

This disclosure contemplates an unconventional cooling system that partially floods one of the freezers (e.g., the ice cream freezer) such that the refrigerant discharged by the freezer includes a liquid component. In this manner, the freezers can operate at the same saturated suction temperature. A heat exchanger can be used to transfer heat to the liquid component of the discharge to evaporate the liquid component. In this manner, refrigerant from another portion of the cooling system can be cooled, thereby increasing efficiency. Additionally, the same compressor can be used to compress the refrigerant from the freezers without needing to install pressure control valves at the outlets of the freezers. Certain embodiments of the cooling system are described below.

According to an embodiment, a system includes a flash tank, a first low side heat exchanger, a second low side heat exchanger, a first compressor, and a heat exchanger. The flash tank stores refrigerant. The first low side heat exchanger uses refrigerant from the flash tank to cool a first space proximate the first low side heat exchanger. The second low side heat exchanger uses refrigerant from the flash tank to cool a second space proximate the second low side heat exchanger. The refrigerant discharged by the second low side heat exchanger includes a liquid portion and a gaseous portion. The first compressor compresses the refrigerant discharged by the first and second low side heat exchangers. The heat exchanger transfers heat from refrigerant discharged by the first compressor to the refrigerant discharged by the second low side heat exchanger before the refrigerant discharged by the second low side heat exchanger is compressed by the first compressor.

According to another embodiment, a method includes storing, by a flash tank, a refrigerant. The method also includes using, by a first low side heat exchanger, refrigerant from the flash tank to cool a first space proximate the first low side heat exchanger and using, by a second low side heat exchanger, refrigerant from the flash tank to cool a second space proximate the second low side heat exchanger. The refrigerant discharged by the second low side heat exchanger includes a liquid portion and a gaseous portion. The method further includes compressing, by a first compressor, the refrigerant discharged by the first and second low side heat exchangers and transferring, by a heat exchanger, heat from refrigerant discharged by the first compressor to the refrigerant discharged by the second low side heat exchanger before the refrigerant discharged by the second low side heat exchanger is compressed by the first compressor.

According to yet another embodiment, a system includes a flash tank, a first low side heat exchanger, a second low side heat exchanger, a first compressor, and a heat exchanger. The flash tank stores refrigerant. The first low side heat exchanger uses refrigerant from the flash tank to cool a first space proximate the first low side heat exchanger. The second low side heat exchanger uses refrigerant from the flash tank to cool a second space proximate the second low side heat exchanger. The refrigerant discharged by the second low side heat exchanger includes a liquid portion and a gaseous portion. The first compressor compresses the refrigerant discharged by the first and second low side heat exchangers. The heat exchanger transfers heat to the refrigerant discharged by the second low side heat exchanger before the refrigerant discharged by the second low side heat exchanger is compressed by the first compressor.

Certain embodiments provide one or more technical advantages. For example, an embodiment partially floods one or more low side heat exchangers so that the same compressor can be used to compress refrigerant from different low side heat exchangers that cool spaces to different temperatures without needing to install pressure control valves at the outlets of these low side heat exchangers. As another example, an embodiment improves efficiency by providing cooling to other portions of the cooling system using the refrigerant from the partially flooded low side heat exchanger. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
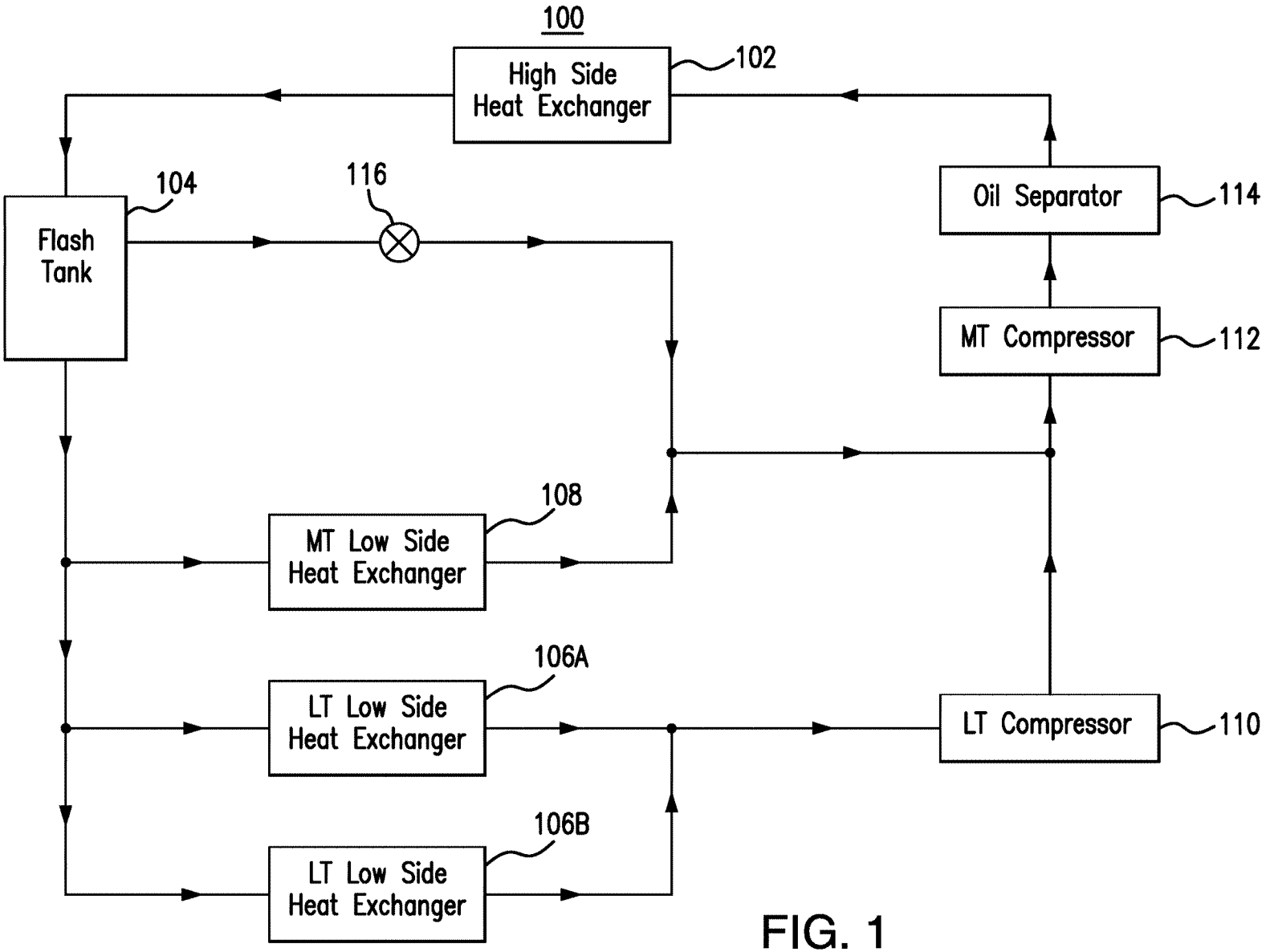
FIG. 1 illustrates an example cooling system.
Figure 2A:
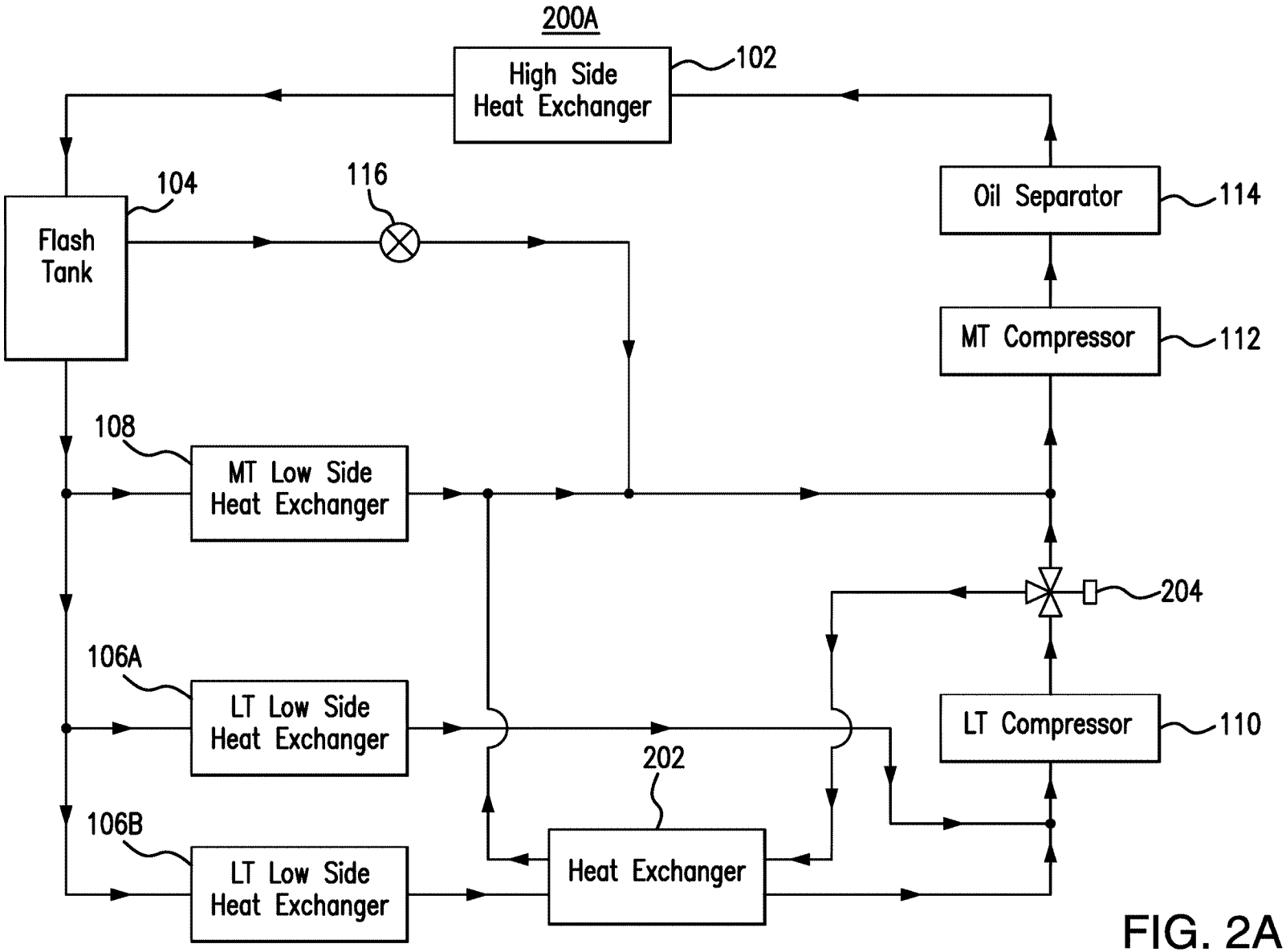
FIGS. 2A-2D illustrate example cooling systems.
Figure 2B:
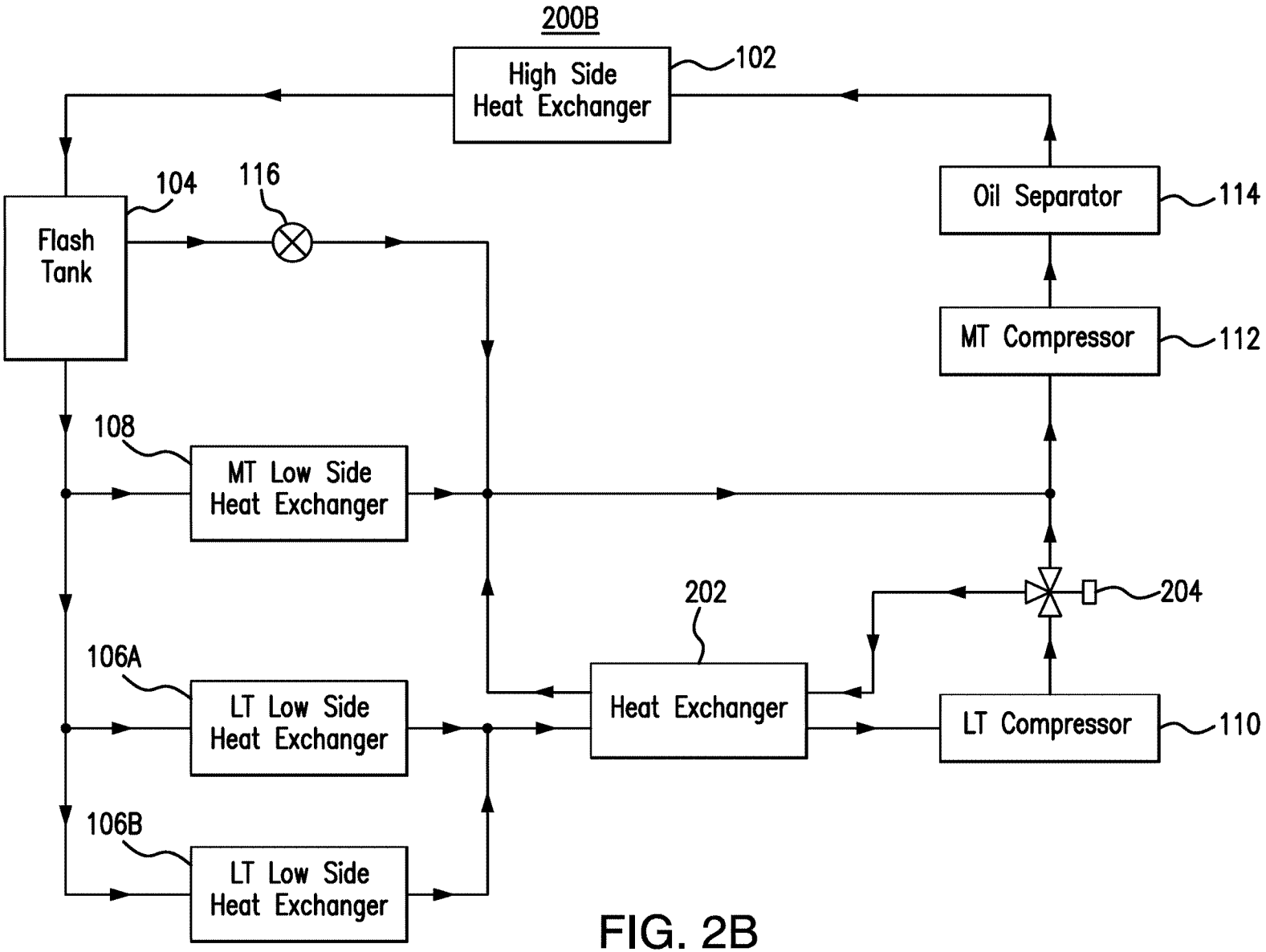
Figure 2C:
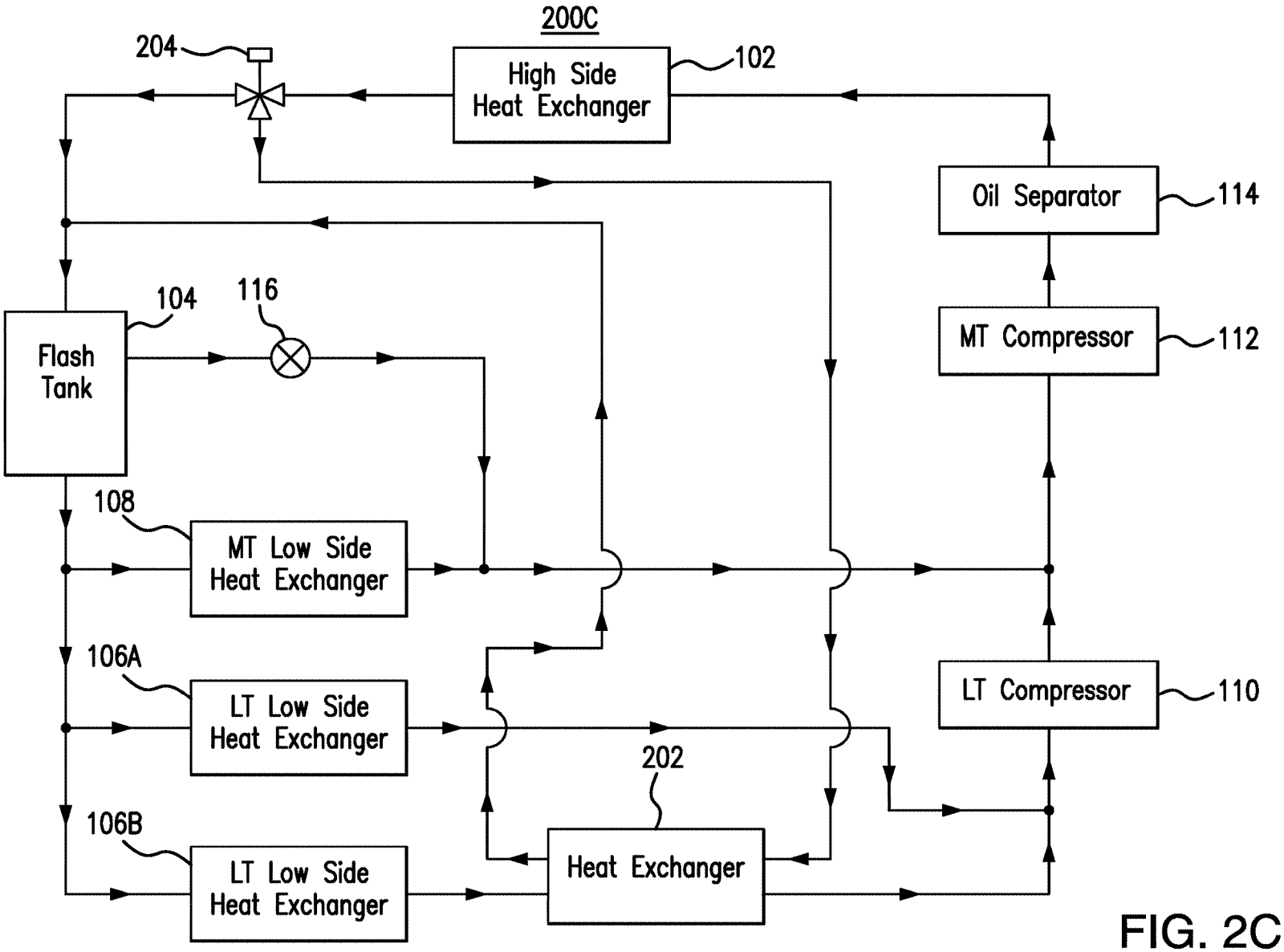
Figure 2D:
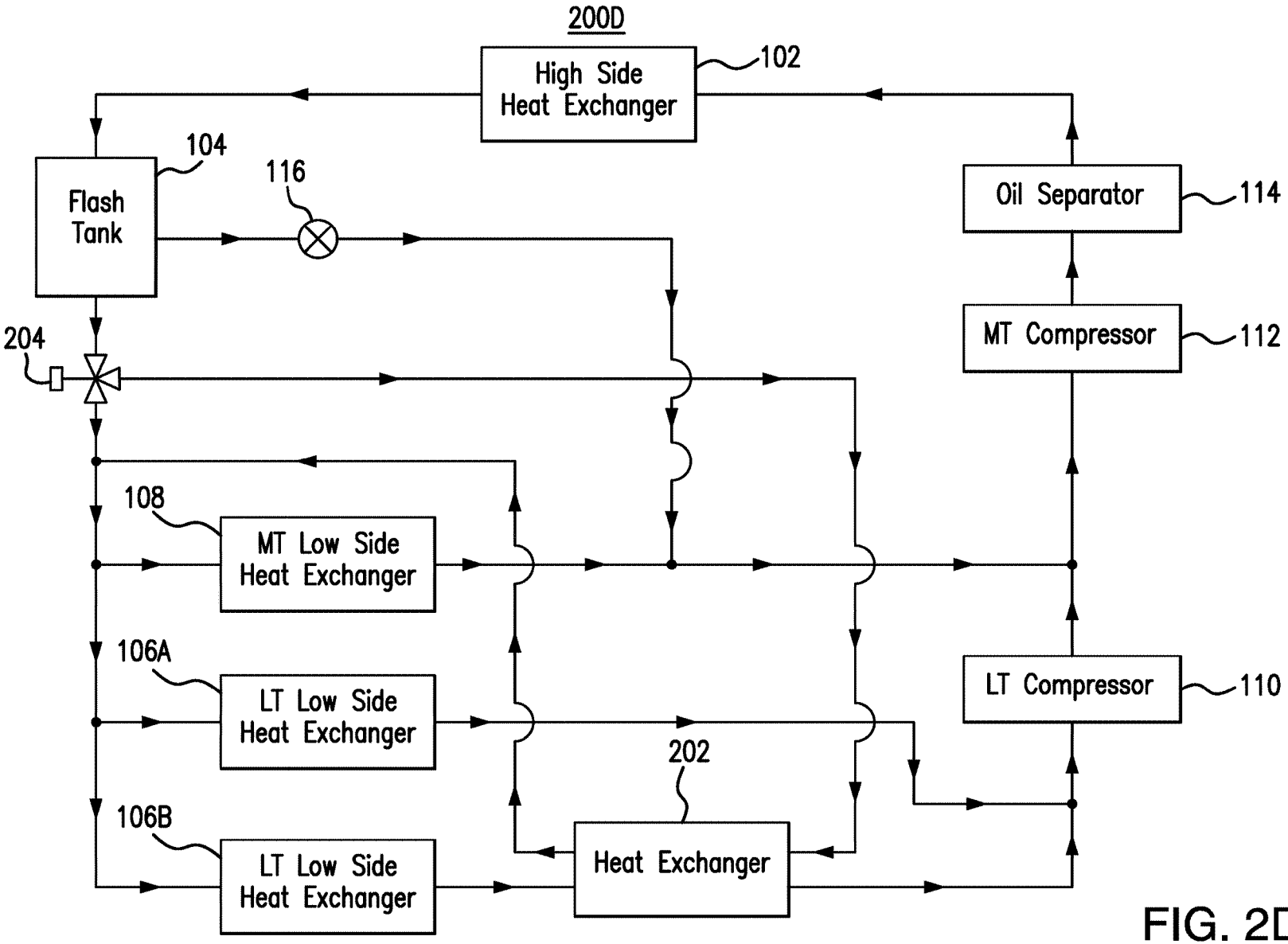
Figure 3:
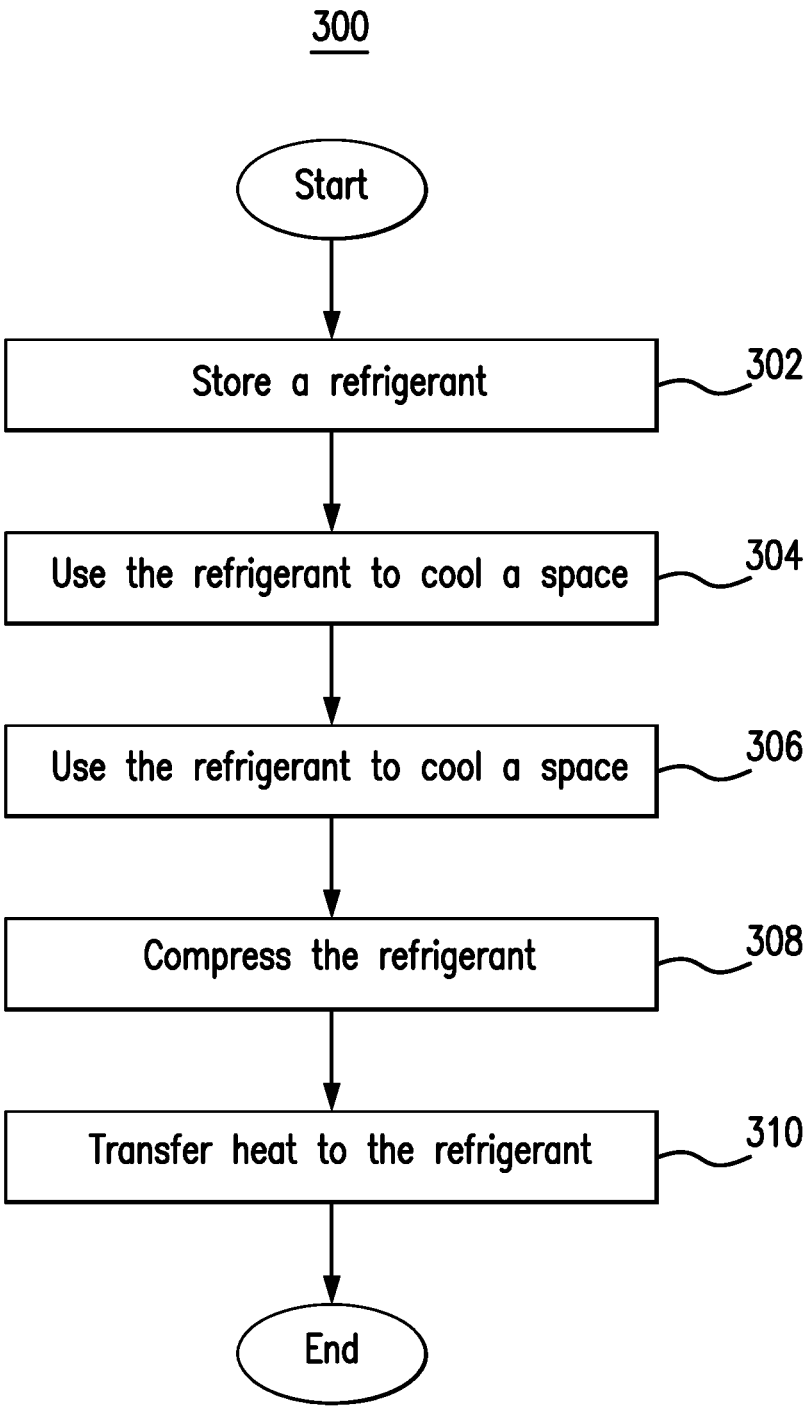
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Cooling systems may cycle a refrigerant (e.g., carbon dioxide refrigerant) to cool various spaces. These systems include compressors that compress the refrigerant. One type of cooling system is a refrigeration and/or freezing system (e.g., refrigeration shelves and freezers in a grocery store). In these cooling systems, sometimes, the freezers are cooled to different temperatures to handle different types of products. For example, freezers for ice cream are typically kept at a colder temperature (e.g., −25 degrees Fahrenheit) than freezers for other frozen foods (e.g., −20 degrees Fahrenheit). As a result, the refrigerant discharged by these different freezers will be at different temperatures and/or pressures. To avoid having to use a different compressor to compress refrigerant discharged from these different freezers, conventional cooling systems may include electric expansion pressure control valves on the outlets of one or more of these freezers to regulate the pressure of the refrigerant discharged by these freezers. However, these pressure control valves may cause the compressors to use more energy to compress the refrigerant from these freezers.

This disclosure contemplates an unconventional cooling system that partially floods one of the freezers (e.g., the ice cream freezer) such that the refrigerant discharged by the freezer includes a liquid component. In this manner, the freezers can operate at the same saturated suction temperature. A heat exchanger can be used to transfer heat to the liquid component of the discharge to evaporate the liquid component. In this manner, refrigerant from another portion of the cooling system can be cooled, thereby increasing efficiency. Additionally, the same compressor can be used to compress the refrigerant from the freezers without needing to install pressure control valves at the outlets of the freezers. The cooling system will be described using FIGS. 1 through 3. FIG. 1 will describe an existing cooling system. FIGS. 2A-2D and 3 describe the cooling system that allows for compressor bypass.

FIG. 1 illustrates an example cooling system 100. As shown in FIG. 1, system 100 includes a high side heat exchanger 102, a flash tank 104, low temperature low side heat exchangers 106A and 106B, a medium temperature low side heat exchanger 108, a low temperature compressor 110, a medium temperature compressor 112, an oil separator 114, and a valve 116. Generally, system 100 cycles a refrigerant to cool spaces proximate the low side heat exchangers 106 and 108. Cooling system 100 or any cooling system described herein may include any number of low side heat exchangers, whether low temperature or medium temperature.

High side heat exchanger 102 removes heat from a refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. As another example, high side heat exchanger 102 may be positioned external to a building and/or on the side of a building. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchangers 106A and 106B and medium temperature low side heat exchanger 108.

When the refrigerant reaches low temperature low side heat exchangers 106A and 106B or medium temperature low side heat exchanger 108, the refrigerant removes heat from the air around low temperature low side heat exchangers 106A and 106B or medium temperature low side heat exchanger 108. For example, the refrigerant cools metallic components (e.g., metallic coils, plates, and/or tubes) of low temperature low side heat exchangers 106A and 106B and medium temperature low side heat exchanger 108 as the refrigerant passes through low temperature low side heat exchangers 106A and 106B and medium temperature low side heat exchanger 108. These metallic components may then cool the air around them. The cooled air may then be circulated such as, for example, by a fan to cool a space such as, for example, a freezer and/or a refrigerated shelf. As refrigerant passes through low temperature low side heat exchangers 106A and 106B and medium temperature low side heat exchanger 108, the refrigerant may change from a liquid state to a gaseous state as it absorbs heat. Any number of low temperature low side heat exchangers 106 and medium temperature low side heat exchangers 108 may be included in any of the disclosed cooling systems.

Refrigerant flows from low temperature low side heat exchangers 106A and 106B and medium temperature low side heat exchanger 108 to compressors 110 and 112. The disclosed cooling systems may include any number of low temperature compressors 110 and medium temperature compressors 112. Both the low temperature compressor 110 and medium temperature compressor 112 compress refrigerant to increase the pressure of the refrigerant. As a result, the heat in the refrigerant may become concentrated and the refrigerant may become a high-pressure gas. Low temperature compressor 110 compresses refrigerant from low temperature low side heat exchangers 106A and 106B and sends the compressed refrigerant to medium temperature compressor 112. Medium temperature compressor 112 compresses a mixture of the refrigerant from low temperature compressor 110 and medium temperature low side heat exchanger 108.

Oil separator 114 separates an oil from the refrigerant before the refrigerant enters high side heat exchanger 102. The oil may be introduced by certain components of system 100, such as low temperature compressor 110 and/or medium temperature compressor 112. By separating out the oil, the efficiency of high side heat exchanger 102 is maintained. If oil separator 114 is not present, then the oil may clog high side heat exchanger 102, low temperature low side heat exchangers 106A and 106B, and medium temperature low side heat exchanger 108, which may reduce the heat transfer efficiency of system 100, high side heat exchanger 101, low temperature low side heat exchangers 106A and 106B, and medium temperature low side heat exchanger 108.

Valve 116 controls a flow of flash gas from flash tank 104. When valve 116 is closed, flash tank 104 may not discharge flash gas through valve 116. When valve 116 is opened, flash tank 104 may discharge flash gas through valve 116. In this manner, valve 116 may also control an internal pressure of flash tank 104. Valve 116 directs flash gas to medium temperature compressor 112. Medium temperature compressor 112 compresses the flash gas along with refrigerant from low temperature compressor 110 and medium temperature low side heat exchanger 108.

Low temperature low side heat exchangers 106A and 106B may cool corresponding spaces to different temperatures. For example, low temperature low side heat exchanger 106A may be a freezer unit for frozen foods typically cooled to −20 degrees Fahrenheit and low temperature low side heat exchanger 106B may be a freezer unit for ice cream typically cooled to −25 degrees Fahrenheit. Because the refrigerant from these two different freezers will be at different temperatures and/or pressures, different compressors should be used to compress the refrigerant from these different freezers, which increases the cost and size of the system 100. To avoid using different compressors, an electric expansion pressure control valve may be installed at the outlets of one or more of the freezers to regulate the pressure of the refrigerant discharge. However, using these valves increases the energy used by a compressor to compress the discharged refrigerant.

This disclosure contemplates an unconventional cooling system that partially floods one of the freezers (e.g., the ice cream freezer) such that the refrigerant discharged by the freezer includes a liquid component. In this manner, the freezers can operate at the same saturated suction temperature. A heat exchanger can be used to transfer heat to the liquid component of the discharge to evaporate the liquid component. In this manner, refrigerant from another portion of the cooling system can be cooled, thereby increasing efficiency. Additionally, the same compressor can be used to compress the refrigerant from the freezers without needing to install pressure control valves at the outlets of the freezers. Embodiments of the cooling system are described below using FIGS. 2A-2D and 3. These figures illustrate embodiments that include a certain number of low side heat exchangers and compressors for clarity and readability. These embodiments may include any suitable number of low side heat exchangers and compressors.

FIGS. 2A-2D illustrate example cooling systems 200. Generally a low temperature low side heat exchanger 106 in cooling systems 200 is partially flooded such that a portion of the refrigerant discharged by that low temperature low side heat exchanger 106 is liquid. A heat exchanger is then used to transfer heat from other portions of systems 200 to the liquid portion of the refrigerant to evaporate that liquid. In this manner, other portions of the cooling systems 200 are cooled, which increases efficiency. Additionally, the same low temperature compressor 110 can be used to compress refrigerant from different low temperature low side heat exchangers 106 that cool spaces to different temperatures.

FIG. 2A illustrates an example cooling system 200A. As seen FIG. 2A, system 200A includes high side heat exchanger 102, flash tank 104, low temperature low side heat exchangers 106A and 106B, medium temperature low side heat exchanger 108, low temperature compressor 110, medium temperature compressor 112, oil separator 114, valve 116, heat exchanger 202, and valve 204. Generally, low temperature low side heat exchanger 106B in system 200A is partially flooded such that a discharge of low temperature low side heat exchanger 106B includes a liquid portion. Heat exchanger 202 transfers heat from the discharge of low temperature compressor 110 to the discharge of low temperature low side heat exchanger 106B to evaporate at least some of the liquid portion. In this manner, the discharge from low temperature compressor 110 is cooled and liquid refrigerant may be prevented from flowing into low temperature compressor 110. Additionally, by partially flooding low temperature low side heat exchanger 106B, the same low temperature compressor 110 can be used to compress refrigerant from low temperature low side heat exchanger 106A and low temperature low side heat exchanger 106B, which may cool spaces to different temperatures.

High side heat exchanger 102, flash tank 104, low temperature low side heat exchangers 106A and 106B, medium temperature low side heat exchanger 108, low temperature compressor 110, medium temperature compressor 112, oil separator 114, and valve 116 operate similarly in system 200A as they did in system 100. For example, high side heat exchanger 102 removes heat from a refrigerant. Flash tank 104 stores the refrigerant. Low temperature low side heat exchangers 106A and 106B and medium temperature low side heat exchanger 108 use refrigerant from flash tank 104 to cool spaces proximate low temperature low side heat exchangers 106A and 106B and medium temperature low side heat exchanger 108. Low temperature compressor 110 compresses refrigerant from low temperature low side heat exchangers 106A and 106B. Medium temperature compressor 112 compresses refrigerant from medium temperature low side heat exchanger 108, low temperature compressor 110, and flash tank 104 (e.g., in the form of flash gas). Oil separator 114 separates oil from the refrigerant from medium temperature compressor 112. Valve 116 controls a flow of flash gas from flash tank 104 to medium temperature compressor 112.

As discussed previously, low temperature low side heat exchanger 106A and low temperature low side heat exchanger 106B may cool spaces to different temperatures. For example, low temperature low side heat exchanger 106A may be a freezer unit for frozen foods that cools a space to −20 degrees Fahrenheit while low temperature low side heat exchanger 106B may be a freezer unit for ice cream that cools the space to −25 degrees Fahrenheit. In system 200A, low temperature low side heat exchanger 106B is partially flooded such that a discharge from low temperature low side heat exchanger 106B includes both a liquid component and a gaseous component. To partially flood low temperature low side heat exchanger 106B, additional liquid refrigerant from flash tank 104 is allowed to flow into low temperature low side heat exchanger 106B. There may not be sufficient heat transfer in low temperature low side heat exchanger 106B to evaporate all of the liquid refrigerant flowing into low temperature low side heat exchanger 106B. As a result, the discharge of low temperature low side heat exchanger 106B includes both a liquid portion and a gaseous portion. In certain embodiments the discharge from low temperature low side heat exchanger 106B is 5% to 10% liquid by mass.

Heat exchanger 202 transfers heat from the discharge of low temperature compressor 110 to the discharge of low temperature low side heat exchanger 106B in system 200A. In this manner, the liquid portion of the discharge from low temperature low side heat exchanger 106B may be evaporated to prevent liquid refrigerant from flowing to low temperature compressor 110. Heat exchanger 202 may include components such as tubes, plates, fins, or coils that allow heat transfer between the refrigerant from low temperature compressor 110 and low temperature low side heat exchanger 106B. Heat exchanger 202 directs the refrigerant from low temperature low side heat exchanger 106B to low temperature compressor 110 and the refrigerant from low temperature compressor 110 to medium temperature compressor 112.

Valve 204 controls a flow of refrigerant from low temperature compressor 110 in system 200A. Valve 204 may be a three-way valve that can direct a portion of the discharge from low temperature compressor 110 to heat exchanger 202 and a portion of the discharge of low temperature compressor 110 to medium compressor 112. In this manner, valve 204 controls the amount of refrigerant that flows to heat exchanger 202. Refrigerant that enters valve 204 that is not directed to heat exchanger 202 is directed to medium temperature compressor 112. When more heat needs to be transferred to the refrigerant from low temperature low side heat exchanger 106B, valve 204 can be opened more to direct more refrigerant from low temperature compressor 110 to heat exchanger 202. When less heating of the refrigerant from low temperature low side heat exchanger 106B is needed, valve 204 can be closed more to direct less refrigerant from low temperature compressor 110 to heat exchanger 202.

Valve 204 can be positioned at different locations in a cooling system to direct refrigerant from different locations to heat exchanger 202. In this manner, heat exchanger 202 can transfer heat from different portions of a cooling system to other portions of the cooling system. FIGS. 2B-2D illustrate some alternative configurations for heat exchanger 202 and valve 204.

FIG. 2B illustrates an example cooling system 200B. Generally, cooling system 200B operates similarly as cooling system 200A, except in cooling system 200B, heat exchanger 202 transfers heat from the discharge of low temperature compressor 110 to the discharge from low temperature low side heat exchanger 106A and low temperature low side heat exchanger 106B. As a result, system 200B allows the discharge from low temperature low side heat exchanger 106B to mix with the discharge from low temperature low side heat exchanger 106A before entering heat exchanger 202. As a result, some of the liquid portion of the discharge from low temperature low side heat exchanger 106B may be evaporated by the discharge from low temperature low side heat exchanger 106A before reaching heat exchanger 202.

FIG. 2C illustrates an example cooling system 200C. Generally, system 200C operates similarly as system 200A, except in system 200C, heat from the discharge of high side heat exchanger 102, and not the discharge of low temperature compressor 110, is transferred to the discharge of low temperature low side heat exchanger 106B. Valve 204 is positioned between high side heat exchanger 102 and flash tank 104. Valve 204 can direct all or some of the refrigerant from high side heat exchanger 102 to heat exchanger 202 depending on how much heat needs to be transferred to the discharge of low temperature low side heat exchanger 106B. Heat exchanger 202 directs the refrigerant from valve 204 to flash tank 104 after heat transfer is complete.

FIG. 2D illustrates an example cooling system 200D. Generally, system 200D operates similarly as system 200A, except in system 200D, heat from the refrigerant from flash tank 104, and not the refrigerant from low temperature compressor 110, is transferred to the refrigerant from low temperature low side heat exchanger 106B. Valve 204 is positioned between flash tank 104 and low temperature low side heat exchangers 106A and 106B and medium temperature low side heat exchanger 108. Valve 204 is configured to direct all or some of the refrigerant from flash tank 104 to heat exchanger 202 depending on the amount of heat that needs to be transferred to the refrigerant from low temperature low side heat exchanger 106B. Heat exchanger 202 directs the refrigerant from valve 204 to low temperature low side heat exchanger 106A and 106B and medium temperature low side heat exchanger 108 after heat transfer is complete.

FIG. 3 is a flow chart illustrating a method 300 of operating an example cooling system 200. Generally, various components of cooling systems 200A-200D perform the steps of method 300. In particular embodiments, by performing method 300, refrigerant from portions of cooling systems 200A-D is cooled thereby increasing efficiency. Additionally, the same compressor 110 can be used to compress refrigerant from different low temperature low side heat exchangers 106 that cool spaces to different temperatures.

Flash tank 104 stores a refrigerant in step 302. In step 304, low temperature low side heat exchanger 106A uses the refrigerant from flash tank 104 to cool a space. In step 306, low temperature low side heat exchanger 106B uses the refrigerant from flash tank 104 to cool a space. Low temperature low side heat exchanger 106A may cool a space to a different temperature than low temperature low side heat exchanger 106B. For example, low temperature low side heat exchanger 106A may be a freezer unit that cools a space to −20 degrees Fahrenheit while low temperature low side heat exchanger 106B is a freezer unit for ice cream that cools a space to −25 degrees Fahrenheit. Low temperature low side heat exchanger 106B may be partially flooded such that the discharge of low temperature low side heat exchanger 106B includes a liquid component and a gaseous component.

Low temperature compressor 110 compresses the refrigerant from low temperature low side heat exchanger 106A and low temperature low side heat exchanger 106B in step 308. Heat exchanger 202 transfers heat to the refrigerant from low temperature low side heat exchanger 106B before that refrigerant reaches low temperature compressor 110 in step 310. Heat exchanger 202 may receive source heat from various portions of the cooling systems 200A-200D. For example, heat exchanger 202 may transfer heat from a discharge of low temperature compressor 110, a discharge of high side heat exchanger 102, and/or a discharge of flash tank 104. Heat exchanger 202 transfers the refrigerant low temperature low side heat exchanger 106B to low temperature compressor 110 after heat transfer is complete.

Modifications, additions, or omissions may be made to method 300 depicted in FIG. 3. Method 300 may include more, fewer, or other steps. For example, steps may be performed in parallel or in any suitable order. While discussed as systems 200A-200D (or components thereof) performing the steps, any suitable component of systems 200A-200D may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the low temperature low side heat exchanger) even though there may be other intervening components between the particular component and the destination of the refrigerant. For example, the low temperature compressor receives a refrigerant from the low temperature low side heat exchanger even though there is a heat exchanger between the low temperature low side heat exchanger and the low temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store refrigerant;

a first low side heat exchanger configured to use refrigerant from the flash tank to cool a first space proximate the first low side heat exchanger;

a second low side heat exchanger configured to use refrigerant from the flash tank to cool a second space proximate the second low side heat exchanger, the refrigerant discharged by the second low side heat exchanger comprises a liquid portion and a gaseous portion;

a first compressor configured to compress the refrigerant discharged by the first and second low side heat exchangers; and an additional heat exchanger configured to transfer heat from refrigerant discharged by the first compressor to the refrigerant discharged by the second low side heat exchanger before the refrigerant discharged by the second low side heat exchanger is compressed by the first compressor.

2. The system of claim 1, further comprising:

a third low side heat exchanger configured to use refrigerant from the flash tank to cool a third space proximate the third low side heat exchanger to a temperature that is greater than the first and second spaces; and a second compressor configured to compress refrigerant from the third low side heat exchanger and refrigerant from the first compressor.

3. The system of claim 2, wherein the second compressor is further configured to compress a flash gas from the flash tank.

4. The system of claim 1, wherein the second low side heat exchanger is configured to cool the second space to a temperature that is colder than the first space.

5. The system of claim 1, further comprising a valve configured to direct a portion of the refrigerant discharged by the first compressor such that the portion of the refrigerant bypasses the additional heat exchanger.

6. The system of claim 1, wherein the additional heat exchanger is further configured to transfer heat to the refrigerant discharged by the first low side heat exchanger before the refrigerant discharged by the first low side heat exchanger is compressed by the first compressor.

7. The system of claim 1, wherein the liquid portion evaporates when the additional heat exchanger transfers heat from refrigerant discharged by the first compressor to the refrigerant discharged by the second low side heat exchanger.

8. A method comprising:

storing, by a flash tank, a refrigerant;

using, by a first low side heat exchanger, refrigerant from the flash tank to cool a first space proximate the first low side heat exchanger;

using, by a second low side heat exchanger, refrigerant from the flash tank to cool a second space proximate the second low side heat exchanger, the refrigerant discharged by the second low side heat exchanger comprises a liquid portion and a gaseous portion;

compressing, by a first compressor, the refrigerant discharged by the first and second low side heat exchangers; and transferring, by an additional heat exchanger, heat from refrigerant discharged by the first compressor to the refrigerant discharged by the second low side heat exchanger before the refrigerant discharged by the second low side heat exchanger is compressed by the first compressor.

9. The method of claim 8, further comprising:

using, by a third low side heat exchanger, refrigerant from the flash tank to cool a third space proximate the third low side heat exchanger to a temperature that is greater than the first and second spaces; and compressing, by a second compressor, refrigerant from the third low side heat exchanger and refrigerant from the first compressor.

10. The method of claim 9, further comprising, compressing, by the second compressor, a flash gas from the flash tank.

11. The method of claim 8, further comprising cooling, by the second low side heat exchanger, the second space to a temperature that is colder than the first space.

12. The method of claim 8, further comprising directing, by a valve, a portion of the refrigerant discharged by the first compressor such that the portion of the refrigerant bypasses the additional heat exchanger.

13. The method of claim 8, further comprising transferring, by the additional heat exchanger, heat to the refrigerant discharged by the first low side heat exchanger before the refrigerant discharged by the first low side heat exchanger is compressed by the first compressor.

14. The method of claim 8, wherein the liquid portion evaporates when the additional heat exchanger transfers heat from refrigerant discharged by the first compressor to the refrigerant discharged by the second low side heat exchanger.

15. A system comprising:

a flash tank configured to store refrigerant;

a first low side heat exchanger configured to use refrigerant from the flash tank to cool a first space proximate the first low side heat exchanger;

a second low side heat exchanger configured to use refrigerant from the flash tank to cool a second space proximate the second low side heat exchanger, the refrigerant discharged by the second low side heat exchanger comprises a liquid portion and a gaseous portion;

a first compressor configured to compress the refrigerant discharged by the first and second low side heat exchangers; and an additional heat exchanger configured to transfer heat to the refrigerant discharged by the second low side heat exchanger before the refrigerant discharged by the second low side heat exchanger is compressed by the first compressor.

16. The system of claim 15, wherein the second low side heat exchanger is configured to cool the second space to a temperature that is colder than the first space.

17. The system of claim 15, further comprising a valve configured to direct a portion of the refrigerant discharged by the first compressor such that the portion of the refrigerant bypasses the additional heat exchanger.

18. The system of claim 15, wherein the heat is provided by the refrigerant discharged by the first compressor.

19. The system of claim 15, wherein the heat is provided by refrigerant from at least one of the flash tank and a high side heat exchanger.

20. The system of claim 15, wherein the additional heat exchanger is further configured to transfer heat to the refrigerant discharged by the first low side heat exchanger before the refrigerant discharged by the first low side heat exchanger is compressed by the first compressor.

* * * * *